US008174177B2

(12) United States Patent
Ciampa et al.

(10) Patent No.: US 8,174,177 B2
(45) Date of Patent: May 8, 2012

(54) SEGMENTED CONDUCTIVE COATING FOR A LUMINESCENT DISPLAY DEVICE

(75) Inventors: David Paul Ciampa, Lancaster, PA (US); Samuel Paul Benigni, Lititz, PA (US); Farzad Parsapour, Bartlett, TN (US)

(73) Assignee: Thomson Licensing, Boulogne-Billancourt (FR)

( * ) Notice: Subject to any disclaimer, the term of this patent is extended or adjusted under 35 U.S.C. 154(b) by 120 days.

(21) Appl. No.: 11/922,470

(22) PCT Filed: Jun. 30, 2005

(86) PCT No.: PCT/US2005/023418

§ 371 (c)(1),
(2), (4) Date: Dec. 18, 2007

(87) PCT Pub. No.: WO2007/005014

PCT Pub. Date: Jan. 11, 2007

(65) Prior Publication Data

US 2009/0134774 A1 May 28, 2009

(51) Int. Cl.
*H01J 1/53* (2006.01)
*H01J 1/54* (2006.01)

(52) U.S. Cl. ..... 313/496; 313/495

(58) Field of Classification Search ..... 313/309, 313/311, 495–497
See application file for complete search history.

(56) References Cited

U.S. PATENT DOCUMENTS

| | | | | |
|---|---|---|---|---|
| 5,592,056 | A * | 1/1997 | Peyre et al. | 315/169.1 |
| 5,689,151 | A | 11/1997 | Wallace et al. | |
| 5,760,535 | A | 6/1998 | Moyer et al. | |
| 5,814,934 | A * | 9/1998 | Tsai | 313/495 |
| 6,107,733 | A | 8/2000 | Jager et al. | |
| 6,400,068 | B1 | 6/2002 | Jaskie et al. | |
| 6,635,984 | B1 * | 10/2003 | Shibata | 313/495 |
| 6,771,236 | B1 | 8/2004 | Konishi | |
| 6,774,548 | B2 | 8/2004 | Fran et al. | |
| 7,075,220 | B2 | 7/2006 | Ito et al. | |
| 2003/0030356 | A1 | 2/2003 | Fran et al. | |
| 2004/0169458 | A1 | 9/2004 | Fran et al. | |
| 2006/0091781 | A1 | 5/2006 | Haraguchi et al. | |
| 2006/0290265 | A1 | 12/2006 | Murata | |
| 2007/0241660 | A1 | 10/2007 | Suzuki et al. | |

FOREIGN PATENT DOCUMENTS

| | | |
|---|---|---|
| CN | 1264248 | 8/2000 |
| EP | 1 073 088 A1 | 1/2001 |
| EP | 1073088 A | 1/2001 |
| EP | 1387383 A | 2/2004 |
| EP | 1432004 A | 6/2004 |

(Continued)

OTHER PUBLICATIONS

Search report dated Jan. 25, 2006.

*Primary Examiner* — Joseph L Williams
*Assistant Examiner* — Nathaniel Lee
(74) *Attorney, Agent, or Firm* — Robert D. Shedd; Harvey D. Fried; Richard LaPeruta

(57) ABSTRACT

A luminescent display is provided that comprises: a plurality of individual phosphor elements (13) formed over a glass anode plate (11), and conductive segments (21) formed on each of the individual phosphor elements, wherein each of the conductive segments are electrically isolated from one another and have an anode potential (15) applied thereto.

8 Claims, 3 Drawing Sheets

FOREIGN PATENT DOCUMENTS

| | | | |
|---|---|---|---|
| EP | 1 635 372 | A1 | 3/2006 |
| EP | 1 830 380 | A1 | 9/2007 |
| JP | 9283063 | | 10/1997 |
| JP | 11162637 | | 6/1999 |
| JP | 2000268638 | | 9/2000 |
| JP | 2001243893 | A | 7/2002 |
| JP | 2003-68237 | A | 3/2003 |
| JP | 2004119395 | | 4/2004 |
| JP | 2006-185614 | A | 7/2006 |
| WO | 2005/096398 | A1 | 10/2005 |
| WO | 2006/068074 | A1 | 6/2006 |

* cited by examiner

SEGMENTED CONDUCTIVE COATING FOR A LUMINESCENT DISPLAY DEVICE

This application claims the benefit, under 35 U.S.C. §365 of International Application PCT/US2005/23418, filed Jun. 30, 2005, which was published in accordance with PCT Article 21(2) on Jan. 11, 2007 in English.

FIELD OF THE INVENTION

The invention pertains to a segmented conductive film on the cathode side of the phosphor screen of a luminescent display device.

BACKGROUND OF THE INVENTION

In a luminescent display such as a Field Emission Display (FED), as shown in FIG. 1, electrons 8 from a plurality of emitters 6 in a cathode 7 strike phosphor 3 on the anode plate 4 and cause photon emission. The brightness of the image that results can be greatly enhanced by applying a thin, aluminum film on the cathode side of the phosphor. Such films are commonly used in CRTs. In CRTs, there is a significant space between the cathode and the anode usually exceeding 25 cm. However, in the case of an FED, the cathode-anode separation is roughly 1-2 mm and the aluminum film will be held at an electrical potential of roughly 5-10 kV relative to the cathode, and as such, arcing may occur across the gap. For a given configuration, the energy of the arc will depend on the size of the aluminum sheet. If the aluminum is applied over the entire anode screen (as it is in CRTs), the arc may be large enough to cause considerable damage to the cathode. This invention involves segmenting the aluminum sheet so as to minimize the capacitance of any individual strip and limit the arc energy.

As shown in FIG. 1, a current practice in FED technology is to apply a transparent conductor 1 (e.g. indium tin oxide) to the glass substrate 2 of the anode 4. Phosphor lines 3 are applied over the transparent conductor 1. The anode potential 5 is then applied to this conductor 1. To emit electrons from particular array emitter apertures 25, a gate potential $V_g$ is applied to specific gates 26 which may be supported on some dielectric material 28. The dielectric material 28 and electron emitters 6 can be supported on a cathode assembly 31 which can be supported on a cathode back plate 29, which in turn is supported on back plate support structure 30.

Experience with CRTs has shown that using an aluminum film on the cathode side of the phosphor greatly enhances the brightness of the displayed image. Unfortunately, since the cathode and anode of a luminescent display such as an FED are so closely spaced (1-2 mm) and roughly 5-10 kV is applied between them, arcing may occur and damage to the cathode/gate structure may result. Therefore, those skilled in the art have avoided conductive layers on the phosphor elements.

SUMMARY OF THE INVENTION

The invention provides, in an exemplary embodiment, a segmented conductive film, where each phosphor element (stripe) or group of phosphor elements on the anode of a luminescent display is covered with its own conductive segment, which may be in the form of an aluminum strip. The conductive segments are each connected to the other segments and to the anode voltage by a resistive bus. The capacitive energy of each conductive segment is significantly less than that of a continuous aluminum film. Meanwhile, the conductive segments provide a conductive surface on which the anode potential may be applied.

The invention involves applying a segmented film of aluminum or other conductive material onto the cathode side of the phosphor elements in a luminescent display such as an FED. Each segment of aluminum would lay directly on top of a phosphor element. Optionally a non-conductive matrix is applied to the glass substrate to optically isolate the conductive segments, wherein the matrix may be in contact with the conductive segment.

DETAILED DESCRIPTION OF THE INVENTION

Figure 1:
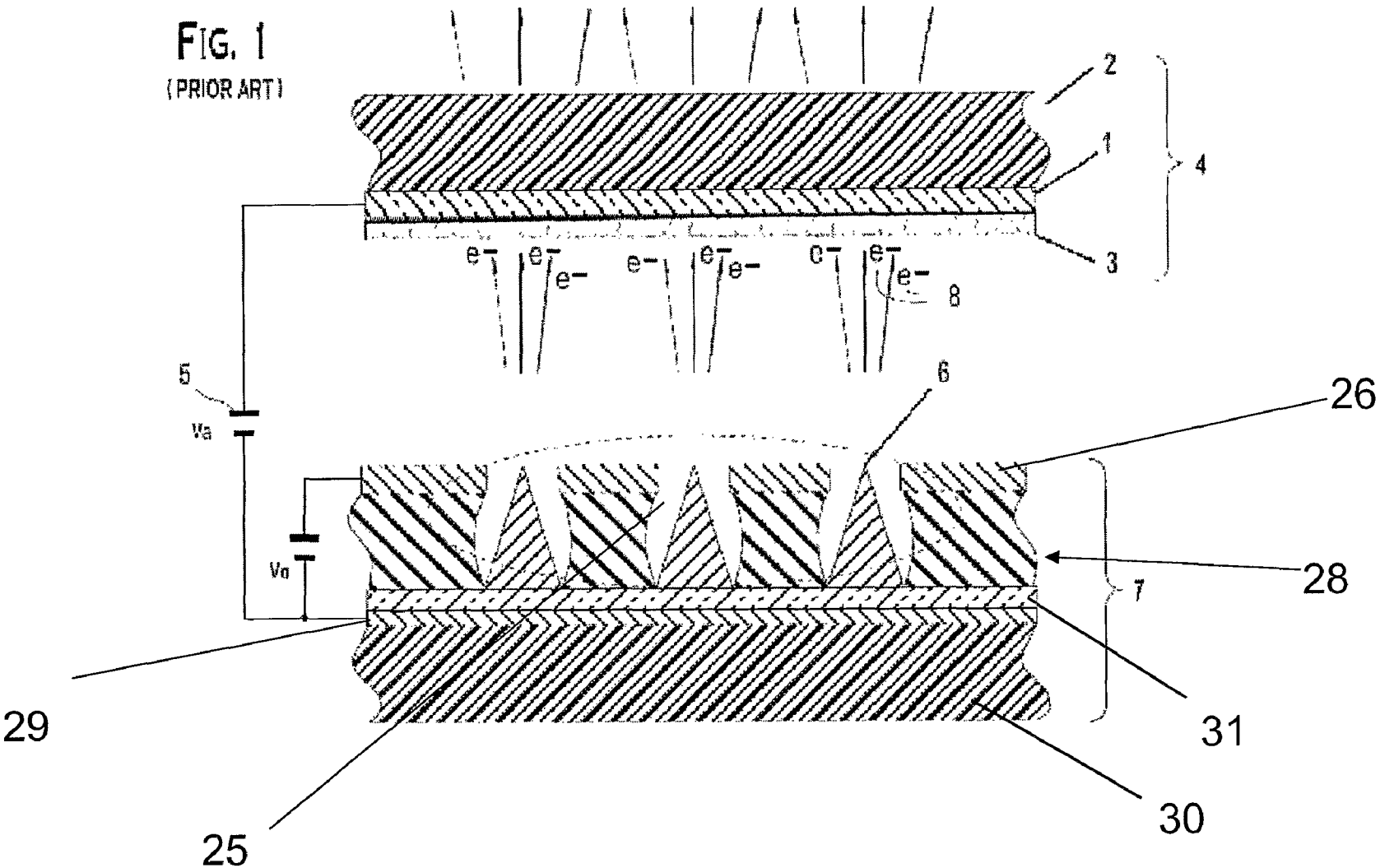
FIG. 1 (PRIOR ART)
FIG. 1 is a sectional view of an existing field emission display.
Figure 2:
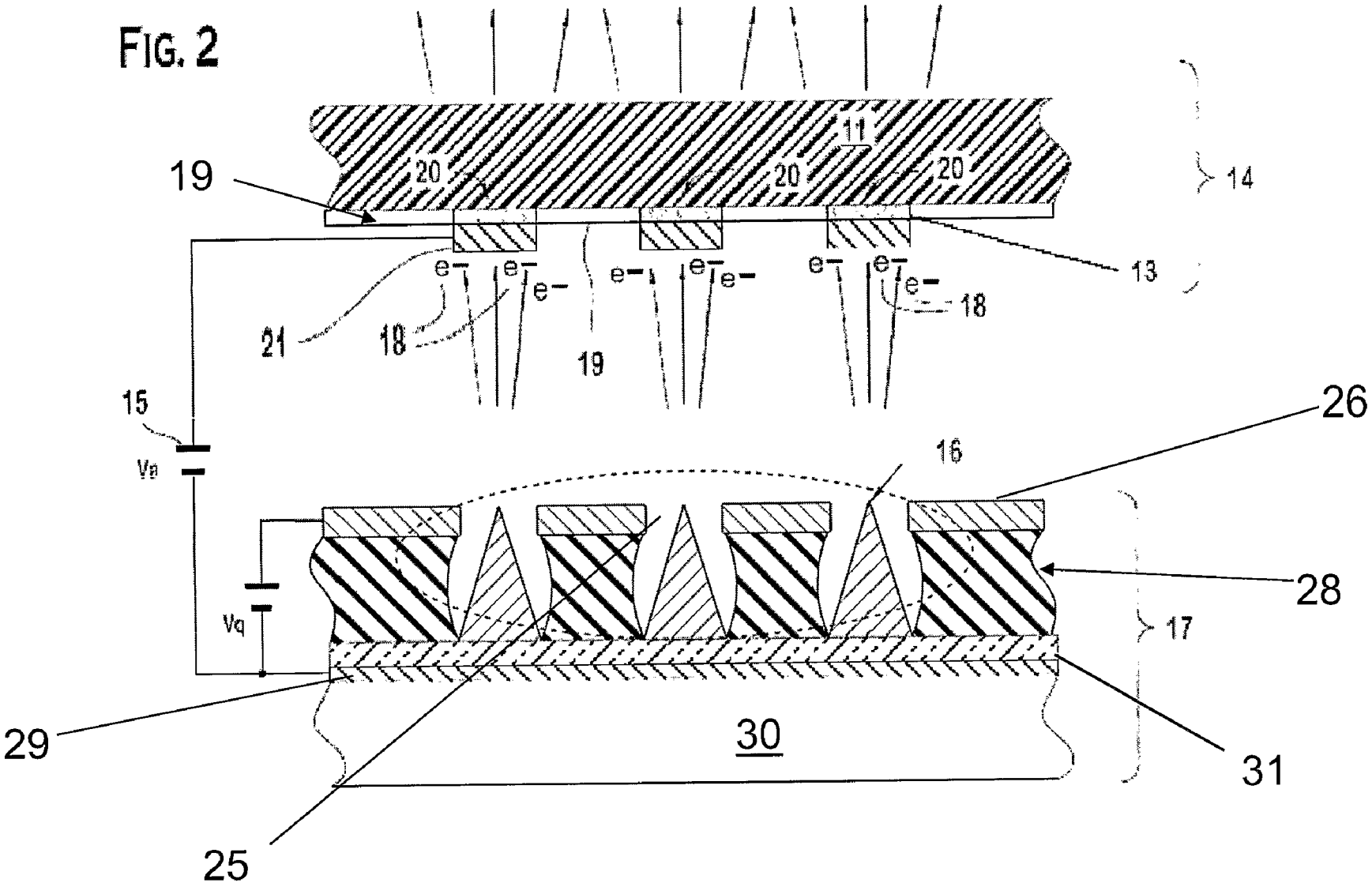
FIG. 2 is a sectional view of a luminescent display according to an exemplary embodiment of the present invention.

An exemplary embodiment of the present invention will next be described with reference to the accompanying figures. As shown in FIG. 2, a cathode 17 comprises a plurality of emitters 16 arranged in an array that emit electrons 18 due to an electric field created in the cathode 17. These electrons 18 are projected toward the anode 14. FIG. 2 also shows that an anode potential 15 is applied to the conductive segments 21.

The anode 14 comprises a glass substrate 11. Optionally, an insulating layer 19 may be formed on the glass substrate 11, having openings 20 formed through the insulating layer 19. The insulating layer 19 may be in the form of a matrix of intersecting black lines that optically isolate the openings 20, and therefore isolate the individual phosphor elements 13 from one another. The insulating layer 19 may be formed using any of a variety of printing techniques.

Individual phosphor elements 13 are formed over the glass substrate 11. In the illustrated exemplary embodiment, these individual phosphor elements 13 are formed in the openings 20 in the insulating layer 19.

The cathode-anode separation can be roughly 1-2 mm and the anode can be held at an electrical potential of roughly 5-10 kV relative to the cathode, for effective operation.

Figure 3:
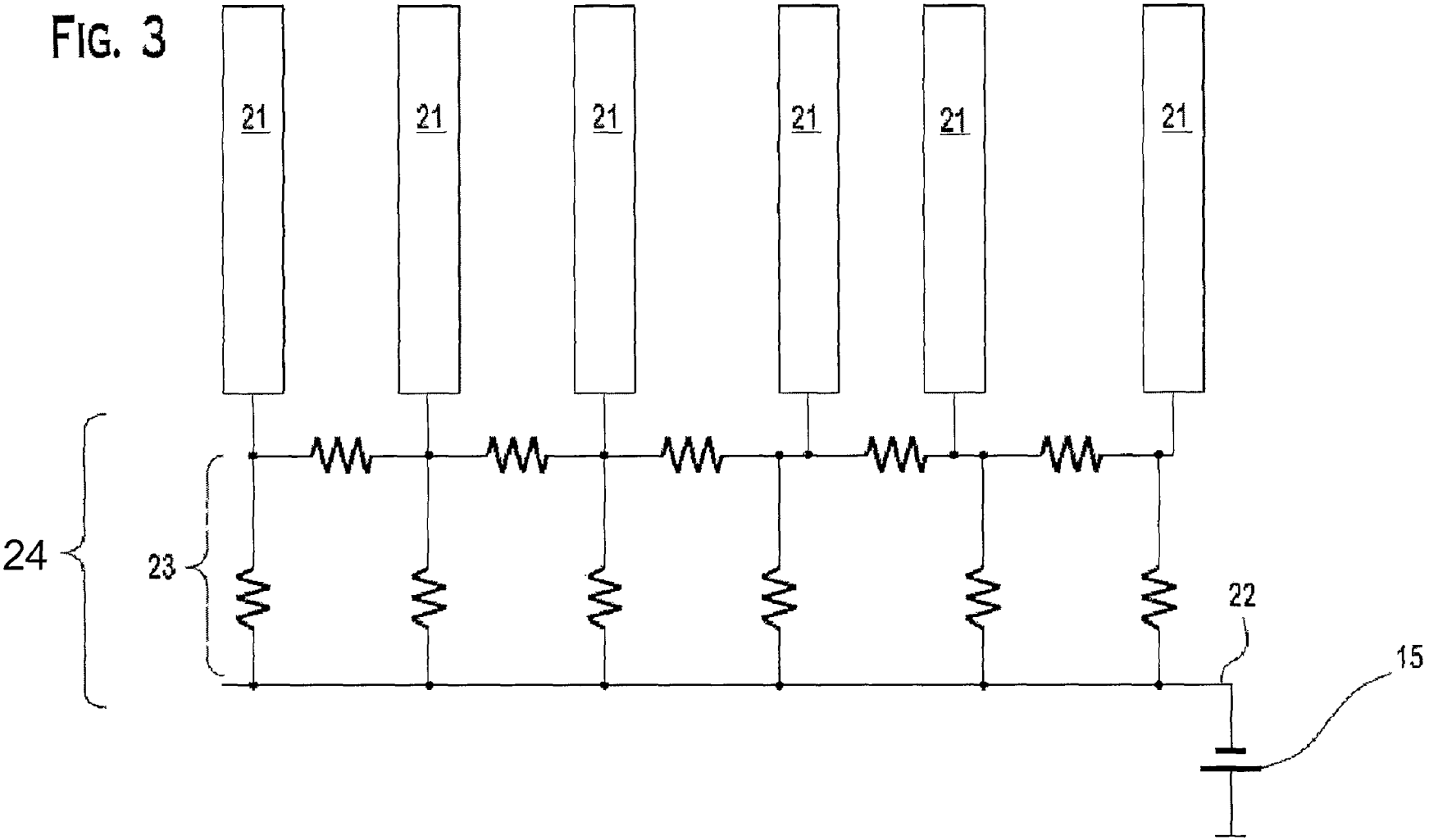
FIG. 3 is an electrical schematic of an anode of a luminescent display according to an exemplary embodiment of the present invention.

Conductive segments 21 shown FIGS. 2 and 3 are formed on each of the individual phosphor elements 13. The conductive segments 21 improve the light output of the luminescent displays because they reflect light generated in the phosphor elements out to the viewer.

Each of the conductive segments 21 are electrically isolated from one another, in the sense that individual segments 21 are separated from each other by a resistance which would inhibit charge flow from multiple segments from arcing through one segment, but yet maintain individual segments 21 at a single potential from a single power supply. In an exemplary embodiment, these conductive segments 21 comprise aluminum, although other metals and other conductive materials may also be used within the scope of the invention. The conductive segments 21 may be applied by sputtering through a mask or by printing, for example.

A planarizing layer may be applied to the phosphor elements 13 prior to the deposition of the conductive segments to further improve the conductive segments' ability to reflect light generated by the phosphor elements 13 out to the viewer, thereby enhancing the light output of the luminescent display.

In an exemplary embodiment, as shown in FIG. 3, the anode potential 15 is applied to the conductive segments 21 through a resistive busbar assembly 24. The resistive busbar assembly 24 comprises a conductive bus 22 electrically connected to the conductive segments through a resistive material or paste 23. The conductive segments 21 are also separated from each other by this resistive material or paste 23. The resistive material or paste may be a composite material comprising an electrical conductor and an oxide mixed with at least one silicate glass. The ratio of the oxide to the electrical conductor in the composite material is used to control the resistivity. The coating should have a large enough resistance to limit the arc energy appreciably and render it harmless to the device (via resistive isolation of the segments). Further, the resistance of the resistive material cannot be too large, otherwise the voltage drop across the resistive material, which varies with beam current, will cause variations in the potential on the segments that will be visible in the screen. Both resistance limits depend on the particular device, i.e., particular device requirements such as size of the device, light output requirements, the width and pitch of phosphor elements, electron beam current, among others, will dictate the applicable resistance limits for the particular device. Suitable oxides may include, for example, aluminum oxide ($Al_2O_3$), iron oxide ($Fe_2O_3$), and titanium dioxide ($TiO_2$), among others. Suitable electrical conductors may include, for example, graphite, antimony, and silver, among others. Suitable silicate glasses may include, for example, potassium silicate, sodium silicate, lead-zinc-borosilicate glass, and devitrifying glass, among others.

The conductive segments 21 provide a conducting surface on which to define the anode potential 15 as well as to increase the brightness of the display image. Segmentation of the conductive segments 21, as opposed to a continuous conductive sheet, decreases the destructive energy of arcs relative to conventional aluminum film applications (i.e., a single continuous film).

An anode potential 15 is applied to the conductive segments 21 via the resistive busbar assembly 24. To emit electrons from particular array emitter apertures 25, a gate potential $V_g$ is applied to specific gates 26 which may be supported on some dielectric material 28. The dielectric material 28 and electron emitters 16 can be supported on a cathode assembly 31 which can be supported on a cathode back plate 29, which in turn is supported on back plate support structure 30.

The foregoing illustrates some of the possibilities for practicing the invention. Many other embodiments are possible within the scope and spirit of the invention. For example, if the phosphor elements 13 exist in vertical columns or in horizontal rows for a respective color, individual conductive segments 21 can span the entire length of the respective vertical column or horizontal row, thereby isolating adjacent vertical columns or horizontal rows or individual conductive segments from each other. Likewise individual conductive segments 21 which may be deposited in vertical columns can cover a plurality of vertical columns of phosphor elements 13. For example, each of the conductive segments 21 shown in FIG. 3 can cover multiple columns of phosphor elements 13. Having the conducting segments 21 covering 2-20 columns or rows of phosphor elements is effective in reducing damage from arcing as compared to having an arc occur when a single continuous metallized layer covers the entire screen. Although having conductive segments 21 covering 2-20 columns or rows of phosphor elements 13 is effective, it is preferred to have the conductive segments cover 1-5 columns or rows of the phosphor elements. Also, even though the invention has been described in the context of an FED display, other types of displays (which can experience improved light output by having conductive coatings on luminescent material, but would otherwise be susceptible to arcing) could also benefit from the teachings of this invention, and as such, those displays are likewise considered features of the invention. Further, displays according to the invention can include groups of conductive segments which are resistively coupled together, but within the groups, individual conductive segments are electrically coupled together without resistance. It is, therefore, intended that the foregoing description be regarded as illustrative rather than limiting, and that the scope of the invention is given by the appended claims together with their full range of equivalents.

What is claimed is:

1. A luminescent display, comprising:

conductive segments positioned on all individual phosphor elements in the display, the phosphor elements being on an anode plate, and a source of anode potential applied to all of the conductive segments through one resistive busbar assembly, the one resistive busbar assembly comprising a conductive bus and one resistive material film;

wherein all of the conductive segments are connected through the one resistive material film and all of the conductive segments are connected to the conductive bus through the one resistive material film.

2. The luminescent display of claim 1, wherein the conductive segments comprise metal film.

3. The luminescent display of claim 2, wherein the conductive segments comprise aluminum film.

4. The luminescent display of claim 1, wherein a patterned insulating layer is positioned on the anode plate and the individual phosphor elements are formed in openings in the insulating layer.

5. The luminescent display of claim 4, wherein the patterned insulating layer comprises a matrix of black lines optically isolating the phosphor elements.

6. The luminescent display of claim 1, wherein the conductive segments are positioned on the cathode side of the individual elements.

7. The luminescent display of claim 1, wherein the anode and cathode are separated by a distance of about 1-2 mm and the anode potential is about 5-10 kV relative to the cathode.

8. An anode comprising:

an insulating layer on a substrate, said insulating layer having openings that contain luminescent materials, all of the openings containing luminescent material on the substrate being covered with conductive segments; and a resistive busbar assembly, the resistive busbar assembly comprising a conductive bus and one resistive material film;

wherein all of the conductive segments are connected through the one resistive material film and all of the conductive segments are connected to the conductive bus through the one resistive material film.

* * * * *